US005165771A

United States Patent [19]

Ballman et al.

[11] Patent Number: 5,165,771

[45] Date of Patent: Nov. 24, 1992

[54] REMOVABLE DRAWER FRONTS

[75] Inventors: Jeffrey J. Ballman; Daniel L. Haynes, both of Washington; Thomas Howland, Winchester; Gary Silvis, Georgetown; Chris Nakoff, Sardinia, all of Ohio

[73] Assignee: MAC Tools, Inc., Columbus, Ohio

[21] Appl. No.: 687,242

[22] Filed: Apr. 18, 1991

[51] Int. Cl.[5] ..... A47B 88/00

[52] U.S. Cl. ..... 312/348.6

[58] Field of Search ..... 16/110 R, 110.5; 312/320

[56] References Cited

U.S. PATENT DOCUMENTS

| | | | |
|---|---|---|---|
| 2,335,931 | 11/1943 | Cushing | 312/320 X |
| 3,000,685 | 9/1961 | Gross . | |
| 3,730,605 | 5/1973 | Eckard . | |
| 4,153,314 | 5/1979 | Prater | 312/320 |
| 4,273,395 | 6/1981 | Martinez et al. . | |
| 4,461,520 | 7/1984 | Aleng . | |
| 4,595,245 | 6/1986 | Rock et al. . | |
| 4,667,822 | 5/1987 | Coopmans . | |
| 4,732,430 | 3/1988 | Byrns | 312/320 X |

*Primary Examiner*—Joseph Falk

*Attorney, Agent, or Firm*—Porter, Wright, Morris & Arthur

[57] ABSTRACT

An improved drawer front assembly for attachment to drawers commonly found in tool boxes and the like. The drawer fronts are removable and replaceable and are attached to the drawers by means other than welding. The fastener means are concealed from view and from touch from outside the drawer. The invention allows for various materials and/or colors and/or styles of drawer fronts to be installed on drawers of tool boxes and the like without substantially altering the traditional tool box/drawer design.

2 Claims, 1 Drawing Sheet

REMOVABLE DRAWER FRONTS

BACKGROUND AND SUMMARY OF THE INVENTION

The present invention relates generally to receptacles having drawers, and more particularly, to improvements in drawer construction for items such as tool boxes, chests, and cabinets having drawers that are capable of being pulled out and pushed in. The improvement the drawer construction of the present invention lies in a assembly for enabling the installation, removal, and rep of drawer fronts on drawers.

It has long been known to articles in drawers of desks, chests, cabinets, boxes, and the like whereby the receptacle is of a height and depth that accommodates the installation of one or more slidable drawers. Typically, the drawers are on tracks or rollers that facilitate opening and closing. The drawers also usually have means for handling, typically at the front of the drawer, so that a person may readily open and close the drawer. It has been common to supply drawers with handles, such as knobs or the like to assist a person in gripping or otherwise touching the drawer to pull it open.

Previously known receptacle construction has typically been focused on functionality of the device and although aesthetics have not been forgotten, greater emphasis has been placed on making drawers that open and close smoothly and which provide numerous mechanical advantages. Many prior designs have been rather simplistic in appearance possibly because of production costs. Large tool boxes fall into this category. In the past, tool boxes have largely been made of sheet metal construction and welded together. In the manufacturing environments that many tool boxes are exposed to, the tool boxes often endure scratches, dents, caustic corrosion, etc. However, due to the tool box construction replacement and/or repair of any exterior surface would be costly and time consuming. Many professional mechanics take great pride in their work and care of their tools. A professional mechanic considers a large tool box to be a valuable asset to his or her trade and worthy of being maintained. Heretofore, repairing damage to the sheet metal of a tool box has been burdensome.

One of the common areas of damage to a tool box is the fronts of drawers which is understandable considering the amount of use they receive and the fact that they are pulled away from the main frame of the tool box. It is not uncommon for a drawer to be opened into another object causing a scratch or dent to appear in the front of the drawer. A need exists for readily replaceable drawer fronts.

The present invention provides a drawer front assembly that can be readily replaced and which adapts to known tool box drawer design. Furthermore, the drawer fronts of the present invention offer the tool box manufacturer the option of different colors, textures, shapes, and materials for the drawer fronts that can be assembled to the drawers in a relatively fast, and secure manner. The drawer fronts of the present invention could be stored as a spare parts item and shipped separately of the entire tool box to previous purchasers of tool boxes needing only drawer front replacements. The drawer fronts of the present invention adapt to existing drawer construction without the permanency of welding and without the visibility of fasteners. The drawer fronts may be painted apart from the frame or body of the tool box to allow for different colors. This also provides the owner with an option of customizing his tool box with unique drawer fronts.

The present invention incorporates a material insert substantially permanently secured to a drawer front, the drawer front having a cavity formed therein. Fastening means are inserted through a front wall of the drawer which pass through the material insert and lie hidden within the cavity formed in the drawer front. Since the drawer front is secured to the material insert and the material insert is now fastened to the front wall of the drawer the drawer front is thereby secured to the drawer. A handle portion may then be fastened to the drawer front by a fastener protruding through the front wall of the drawer and through the drawer front member in such a way that the fastener is not visible or exposed in any way and so that the handle and drawer front may be readily replaced. The foregoing and other advantages of the present invention will become more apparent when viewed in light of the accompanying drawings and following detailed description.

DESCRIPTION OF PREFERRED EMBODIMENT(S)

Figure 1:
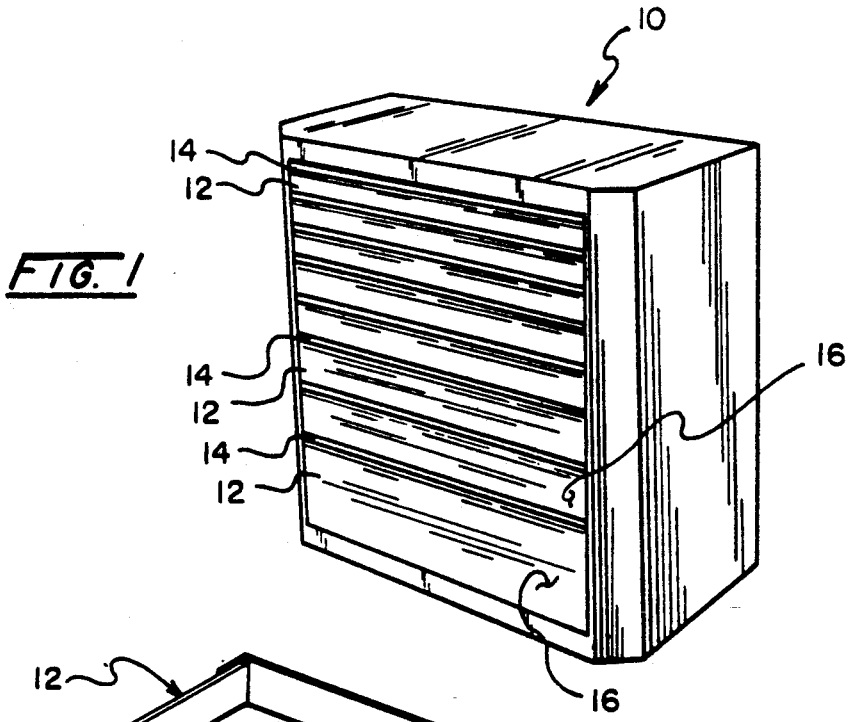
FIG. 1 is a perspective view of a receptacle, such as a tool box.

Referring now to the drawings, and particularly FIG. 1, there is illustrated a receptacle with drawers, in this case a tool box assembly generally indicated at 10 and of a type widely known and used by professional mechanics. The tool box 10 has a plurality of drawers 12 each having a handle portion 14.

Figure 2:
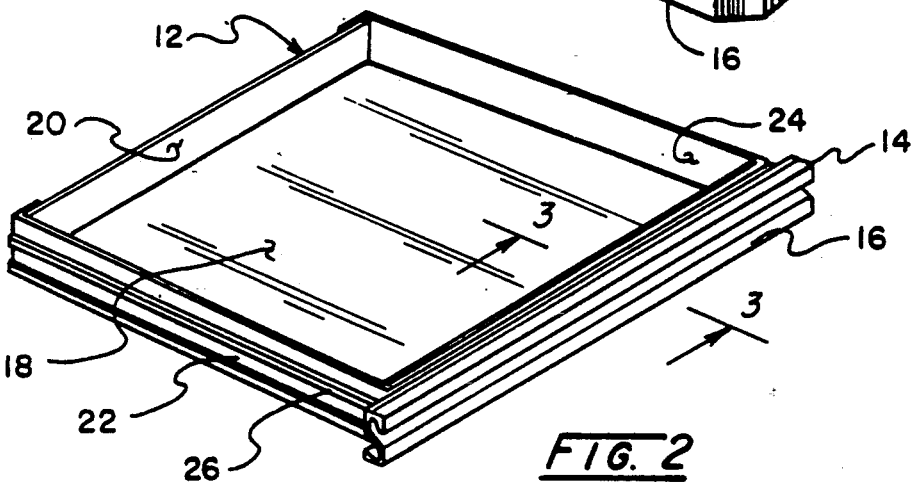
FIG. 2 is a perspective view of a drawer removed from the tool box of FIG. 1.

Referring now to FIG. 2, a drawer 12 is shown apart from the tool box 10. Typical drawer construction includes a front 16, a bottom panel 18, a rear wall 20, and side walls 22, 24. One or more of the side walls 22, 24 may have associated therewith means for assisting in the opening and closing of the drawer 12, such as a track 26.

Figure 3:
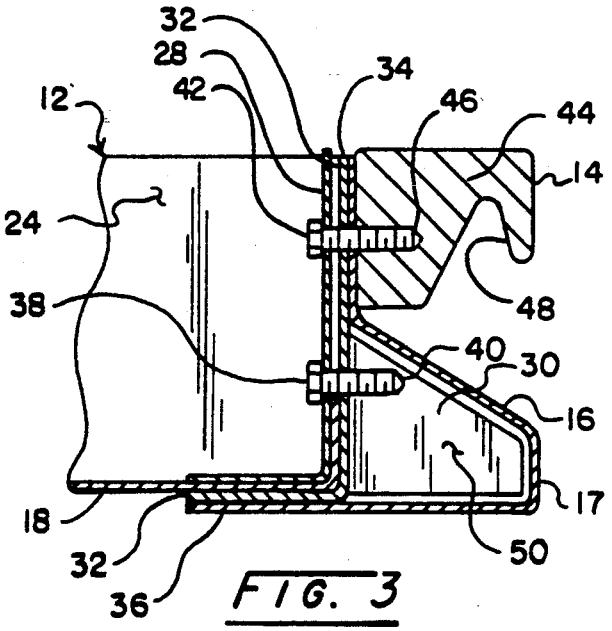
FIG. 3 a section view of the drawer of FIG. 2, the section being taken along lines 3—3 thereof.

Referring now to FIG. 3, a drawer front assembly is shown of the present invention that may be readily removed and replaced. Fastening means are provided which enable the drawer front 16 to be removed from the drawer 12 with relative simplicity. Furthermore, the fastening means are concealed from view and from touch from outside the drawer compartment.

The drawer bottom panel 18 which may be of sheet metal is secured to a front wall 28 which may also be of sheet metal. The bottom panel 18 and the front wall 28 may be welded together. The drawer front -member 16 may also be of sheet metal and formed with a protruding portion 17 forming a cavity therein which will later serve to substantially conceal the fastening means but may also be contured with a pleasing aesthetic appearance. Sandwiched between the drawer front member 16 and the front wall 28 is a material insert 32 that may also be of sheet metal. A top portion 34 and a bottom portion 36 of the drawer front member are secured to the material insert in a relatively permanent fashion such as by welding.

A fastener, such as a threaded screw 38 is inserted through a hole in front wall 28 and another aligned hole in the material insert 32 and is then tightened. The end of the threaded screw 40 will remain concealed from view and from touch within the cavity 30 of the drawer front member 16. By use of the material insert 32, the drawer front member 16 may be attached to the front wall 28 of the drawer without actually being penetrated by the screw 38.

The handle 14 may be attached in a similar manner by a threaded screw 42. A relatively thick portion 44 of the handle 14 will accommodate the screw 42 in a threaded slot 46 keeping the screw 42 from being visible or from being touched from outside the drawer. The drawer front member 16 may be tapered in a direction away from the handle 14 to provide access to a finger pull portion 48 of the handle 14. The material insert 32 may be provided with a wing portion 50 at each end thereof to substantially conceal the cavity 30 formed by the drawer front member 16.

Figure 4:
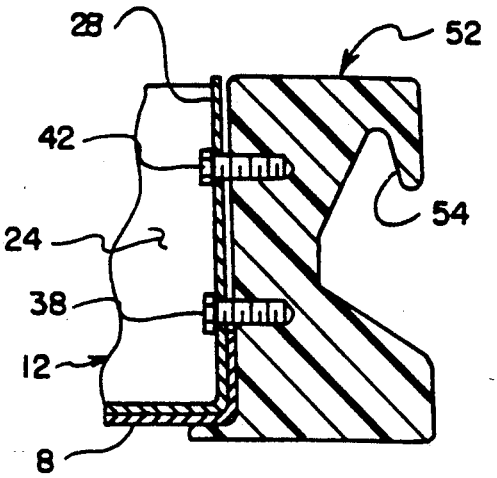
FIG. 4 is a section view of an alternative embodiment of the section shown in FIG. 3.

Referring to FIG. 4, another embodiment of the present invention is shown. In this embodiment, the drawer front and the handle portion are combined in a unitary front 52 having a handle pull 54. Similar fastener means are used to attach the front 52 to the front wall 28 of the drawer 12. In this embodiment, the unitary front 52 may be made of many materials such as plastics, wood, or solid metal stock.

It is thought that the improved drawer front assembly of the present invention and many of its attendant advantages will be understood from the foregoing description. It will be apparent that various changes may be made in the form and construction of the components thereof, including different materials and fastening means, without departing from the spirit and scope of the invention or sacrificing all of its material advantages. The form of the invention hereinbefore described is merely a preferred or exemplary embodiment thereof.

What is claimed is:

1. A drawer front assembly for attachment to the front wall of a drawer of a tool box, said assembly comprising:

a drawer front member of dimensions adapted to fit the front wall of a drawer, said drawer front member having a protruding portion forming a cavity between said protruding portion and said front wall;

a material insert relatively permanently secured between said front wall and said drawer front member; said material insert having at least one wing formed thereon to substantially cover an opening created by said protruding portion;

first fastening means for securing said front wall of said drawer to a portion of said material insert covering said cavity, such that an end of said fastening means remains within said cavity; and a handle secured to a portion of said drawer front member.

2. A drawer front assembly for attachment to the front wall of a drawer, said assembly comprising:

a drawer front member of dimensions adapted to fit the front wall of a drawer, said drawer front member having a protruding portion forming a cavity between said protruding portion and said front wall;

a material insert secured between said drawer front member and said front wall;

fast fastening means for securing said front wall of said drawer to a portion of said material insert covering said cavity, such that an end of said fastening means remains within said cavity; and a handle secured to a portion of said drawer front member, said handle secured to said drawer front member by second fastening means passing through said front wall of said drawer such that an end of said second fastening means remains within said handle.

* * * * *

UNITED STATES PATENT AND TRADEMARK OFFICE

CERTIFICATE OF CORRECTION

PATENT NO. : 5,165,771

DATED : November 24, 1992

INVENTOR(S) : Jeffrey J. Ballman et al

It is certified that error appears in the above-indentified patent and that said Letters Patent is hereby corrected as shown below:

Column 1, line 11, after "improvement" insert --in--;
line 12, after "a" insert --new--;
line 13, "rep" should read --replacement--;
line 14, after "to" insert --store--.

Signed and Sealed this

Seventh Day of December, 1993

*Attest:*

*Attesting Officer*

Bruce Lehman

BRUCE LEHMAN

*Commissioner of Patents and Trademarks*